United States Patent [19]

Schermutzki et al.

[11] 4,145,170

[45] Mar. 20, 1979

[54] APPARATUS FOR PRODUCING SHEETS OF THERMOPLASTIC MATERIAL

[75] Inventors: Konrad Schermutzki, Remseck Am Neckar; Erhard Braun, Murr, both of Fed. Rep. of Germany

[73] Assignee: Sandvik Conveyor GmbH, Fellbach, Fed. Rep. of Germany

[21] Appl. No.: 849,883

[22] Filed: Nov. 9, 1977

[30] Foreign Application Priority Data

Nov. 24, 1976 [DE] Fed. Rep. of Germany ..... 2653266

[51] Int. Cl.[2] ..... B29D 7/02

[52] U.S. Cl. ..... 425/101; 425/223; 425/294; 425/403.1; 425/DIG. 201

[58] Field of Search ..... 425/223, 224, 101, 294, 425/403.1, DIG. 201; 214/1 BV

[56] References Cited

U.S. PATENT DOCUMENTS

| | | | |
|---|---|---|---|
| 2,439,802 | 4/1948 | Francis, Jr. | 425/223 X |
| 2,974,364 | 3/1961 | Lambert et al. | 425/224 X |
| 3,032,815 | 5/1962 | Gerber | 425/224 X |
| 3,771,938 | 11/1973 | Pinto et al. | 425/294 X |
| 3,782,875 | 1/1974 | Olschewski | 425/223 |
| 3,874,831 | 4/1975 | Schroeder | 425/223 X |
| 4,004,870 | 1/1977 | Guttinger et al. | 425/224 |

*Primary Examiner*—Robert L. Spicer, Jr.

*Attorney, Agent, or Firm*—Harold L. Stults; Pasquale A. Razzano

[57] ABSTRACT

An apparatus and method for producing sheets of bitumen in which a layer of liquid bitumen is deposited on a steel belt conveyor and is solidified to form a continuous web. The web is stripped from the conveyor and passes downwardly by the action of gravity to a cutting assembly which cuts the web into lengths to form sheets. The sheets are then stacked upon a discharge conveyor and are adapted for packaging.

8 Claims, 2 Drawing Figures

II

APPARATUS FOR PRODUCING SHEETS OF THERMOPLASTIC MATERIAL

Figures 1, 2:
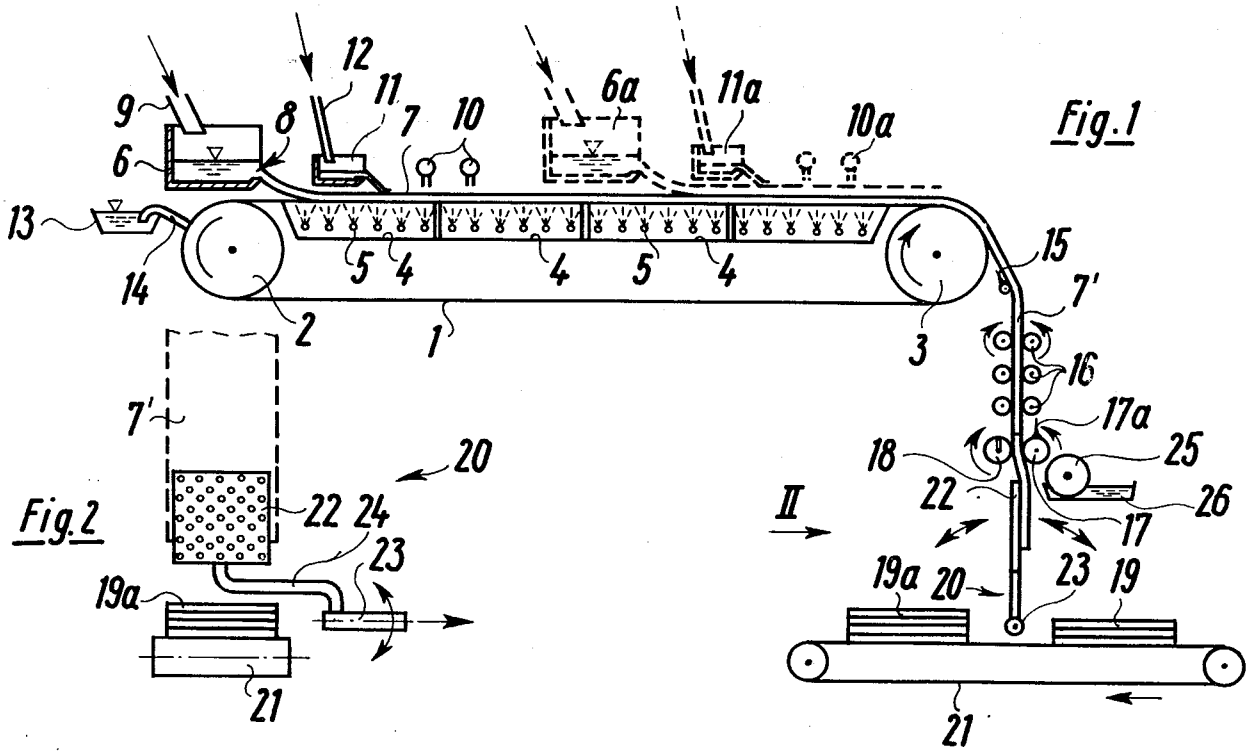

This invention relates to apparatus and methods for producing bitumen sheets by solidifying liquid bitumen.

An object of this invention is to produce bitumen sheets and the like in a manner which overcomes difficulties encountered in the past. A further object is to provide for the efficient and dependable production of sheet material by solidifying a liquid with material such as bitumen. It is desirable to provide smooth top and bottom surfaces on the sheet material. That makes it desirable to avoid procedures in manufacturing and handling which will be apt to damage the sheet material. Furthermore, it is desirable to provide for the efficient handling and packaging of the sheet material. It is an object of the present invention to provide methods and apparatus by which the above can be accomplished.

Apparatus for producing bitumen sheet material is known, for example, see German Patent Application No. 2,314,227. In accordance with that disclosure, a layer of liquid bitumen is deposited on a steel belt conveyor and is cooled as it passes toward the discharge end of the conveyor. The solidified web passes from the belt between a pair of rolls which grip the web and the end of the web is deposited continuously onto a discharge belt conveyor. The gripping rolls are reciprocated parallel to the conveyor surface so that the web is folded into pleats in zig-zag fashion to form a stack on the belt. When the stack reaches a certain height, it is severed from the web and the discharge conveyor moves the stack away. It has been found that the stacks produced in that manner are objectionable in that it is difficult to package them. Also, the pleats in the web are not always the same size. It is a further object of the present invention to provide methods and apparatus which constitute improvements over the prior art discussed above.

Referring to the drawings which show an illustrative embodiment of the invention:

FIG. 1 is a somewhat diagrammatic representation of a system for producing bitumen sheets; and, FIG. 2 is a view from the arrow II in FIG. 1.

Referring to FIG. 1 of the drawings, a conveyor has an endless steel belt 1 mounted upon a pair of end rolls 2 and 3 and having a horizontal top run which is adapted to carry a product from left to right. Driving means of a known type (not shown) rotates roll 3 at a constant rate to operate the conveyor. Below the upper run of the belt there is a series of cooling sections each of which is formed by a tank or pan 4 and a plurality of spray pipes 5. A cooling medium, e.g. brine, is sprayed under pressure from nozzles on pipes 5 onto the underside of the upper run of the belt. The brine is collected in pans 4 and is recirculated through a chiller by a pump back to pipes 5, all in a known manner.

During operation, a layer of bitumen is deposited on the conveyor from a feed tank 6 through a rectangular metering slot 8, and the predetermined level of liquid is maintained in tank 6 through a supply pipe 9. Belt 1 is coated with a film of recycled oil as the belt passes upwardly around roll 2. A wick 14 extends from a body of the oil in a pan 13 downwardly and terminates with its blunt lower end pressed against the belt surface for substantially the full width thereof. Hence, the oil is carried from pan 13 by a wick action and a uniform film of the oil covers the belt as it moves away from roll 2.

That film of oil acts as a release agent between the belt and the layer of bitumen. The bitumen is cooled along its entire bottom surface by the action of the brine spray from pipes 5. It is also cooled at its upper surface by a stream of chilled water which is supplied through a pipe 12 to a tank 11 from which the water flows through an orifice onto the top of the bitumen layer. Jets of cold air are also directed against the top surface of the bottom layer by a plurality of air nozzles 10. When the layer 7 reaches the discharge end of the conveyor, it tends to peel away from the belt by the action of the bending of the belt around roll 3, and adhesion to the belt is prevented by the release agent film. However, a scraper blade 15 is positioned to insure that the bitumen layer does not adhere to the belt. At that time, the bitumen layer is solidified and forms a self-sustaining bitumen web 7′ which is substantially rectangular in cross-section with smooth side surfaces.

Web 7′ is draped downwardly with the aid of gravity and passes between a guide arrangement consisting of three pairs of mating rolls 16 which aid in directing the web in a vertical downward path. Positioned directly below the bottom pair of guide rolls 16 is a cutting unit formed by a cutter roll 17 and an opposing pressure roll 18. Rolls 17 and 18 are rotated together with their opposing surfaces moving at the same rate. Cutter roll 17 has a cutter knife 17*a* which projects radially outwardly from the roll surface so that it projects through the web and severs the portion of the web beneath the knife. Roll 18 has a longitudinal slot into which the leading edge of knife 17*a* nests as roll 17 moves counterclockwise and roll 18 moves clockwise downwardly.

The severed portions of web 7′ are rectangular sheets 19 and 19*a* which are then deposited on a discharge conveyor belt 21 by a pivoted reciprocating assembly 20. Assembly 20 has a suction plate 22 mounted upon a hollow pivot arm 24 (see FIG. 2). Plate 22 is hollow with a pattern of holes in each of its rectangular side faces. Plate 22 is rigidly mounted on the upper end of arm 24 and the arm has a central horizontal portion extending between its connection with plate 22 directly over the center of the conveyor and a pivot shaft 23 upon which arm 24 is rigidly mounted. Shaft 23 has a center bore which is connected at one end to the air passageway in arm 24 and which is connected at the opposite end of the shaft by a suction line which is not shown but which is indicated by a horizontal arrow represented in the drawing to the right.

Plate 22 is adapted to be positioned in alignment (see FIG. 1) with the portion of web 7′ which is held by rolls 16 (see FIG. 2) and with the center line of the plate and the web in substantial alignment. As indicated by the double arrows at the sides of plate 22 in FIG. 1, plate 22 is reciprocated between a position substantially over the stack of sheets 19*a* and the corresponding position with respect to the stack of sheets 19. Hence, as the leading end of web 7′ passes downwardly from rolls 17 and 18, assume that plate 22 has swung to the left from its vertical position and is swinging back to the right, the plate will move against the left-hand side of the end of the web. However, when a predetermined length of the web has reached rolls 17 and 18, the end is severed to form a sheet 19. That sheet is held against the right-hand side of plate 22 by the partial vacuum or suction action effected through the holes in the plate. Therefore, sheet 19 is supported solely by the plate and the plate swings to the right and deposits the sheet on the stack of sheets 19. The suction is then released automatically by a valve (not shown) so that sheet 19 remains on the stack. Arm 24 and plate 22 then swing counterclockwise to the vertical position shown in the Figures and encounters the projecting web 7' with the web now being on the left-hand side of the plate. The end of the web is then cut off to form a sheet 19*a*, and the arm and plate swing to the left and deposit the sheet onto the stack of sheets 19*a*. The timing of the reciprocating action of plate 22 is such with respect to the longitudinal movement of web 7' that each severed sheet is picked off and moved to its stack in a dependable manner.

Web 7' is produced at a constant rate and the sheets are severed and stacked in an efficient and dependable manner. When stacks of the desired height have been formed on belt 21, the belt is operated to discharge them onto another conveyor which is not shown. It is also understood that belt 21 can be much longer so that the stacks remain on the belt while they are being packaged. Under some circumstances, it is desirable to produce thicker bitumen webs in which case a second layer of liquid bitumen may be added from a tank 6*a* and cooled by water from tank 11*a* and air from nozzles 10*a*. Those components operate in the same manner as the components formed by tanks 6 and 11, and nozzles 10.

The action of knife 17*a* is improved by a felt roll 25, the bottom portion of which is positioned in a body of oil in a pan 26 so that the roll acts as a wick which is saturated with the oil. Hence, knife 17*a* presses into roll 25 during each revolution so as to coat the knife with the oil. The oil then acts as a release coating and prevents the bitumen from sticking to the knife.

The method and apparatus of the present invention permits the production of neat stacks of the sheets of material in an efficient and dependable manner. The liquid bitumen or another product having a characteristic of being formed into sheets is solidified on the conveyor to form the web. The web is then passed downwardly along a substantially vertical path through the guide rolls to the cutting mechanism. Predetermined lengths of the web are cut off automatically to form individual sheets and each sheet is received by the suction plate which is oscillated in timed relationship to the production of the sheets. The timing system insures that the suction plate will approach its vertical position simultaneously with the arrival of a sheet as it starts to fall after being cut from the web. The sheet is therefore grasped by the suction action and is held flat against the plate as the plate continues to move and swings downwardly. The sheet is precisely located on the discharge conveyor so that a neat stack is produced.

The invention contemplates other embodiments of the invention and modifications of the embodiment disclosed, all within the scope of the claims.

What is claimed is:

1. In apparatus for producing rectangular sheets of a product from a liquid, the combination of, a conveyor having a substantially horizontal top run adapted to carry a product from a receiving station to a discharge station, means to deposit the product on said top run at said receiving station, means to effect the solidification of the product while on said top run whereby a continuous web of the product is formed, means to guide said web substantially downwardly from said discharge station, means to sever said web into predetermined lengths to form sheets whereby the sheets are free from the web and are positioned vertically in a vertical zone, and means which move along a path which is substantially horizontal within said zone and which presents a product-receiving structure which is parallel to and moves against one side face of each of said sheets within said zone, including means to move the sheet along a predetermined path transversly with respect to the side faces of the sheet to a stacking position wherein its side faces are substantially horizontal.

2. Apparatus as described in claim 1, which includes means to apply a release film to said belt upstream from said receiving station, and wherein said means to deposit the product comprises tank means having a liquid outlet opening through which a layer of liquid flows onto said belt.

3. Apparatus as described in claim 1, wherein the said product which is deposited is liquid bitumen, and wherein said means to effect solidification of the product comprises means to spray chilled liquid against the bottom surface of said top run, and means to deposit cooling water upon the top surface of said bitumen.

4. Apparatus as described in claim 3, wherein said means which moves horizontally within said zone comprises a plate having a side face with holes therein, and means to draw air into said holes to thereby produce a suction effect holding each of said sheets to said surface of said plate, and mounting means pivotally supporting said plate and operative to swing said plate from said vertical zone to thereby move the said sheet to said stacking position.

5. Apparatus as described in claim 4, wherein said mounting means comprises an arm pivotally mounted below said vertical zone and adapted to swing said plate with an oscillating movement between two stacking positions upon opposite sides of the pivotal axis in timed relationship with the arrival of said sheets at said zone, whereby said plate encounters one of said sheets when swinging in one direction and moves that sheet to one of said stacking positions and then encounters the next of said sheets when moving in the opposite direction and moves said next sheet to said other stacking position.

6. Apparatus as described in claim 5, wherein said means to sever said web comprises a rotating knife roller and an opposing roller, and means to apply a release film to a cutting edge of said knife roller.

7. Apparatus as described in claim 5, wherein said plate has two of side faces with holes therein which are substantially the shape of the sheets, and wherein the arm upon which said plate is mounted has an air passageway through which air is drawn from said holes.

8. In a system for producing sheets of a material solidified from a liquid, a cooling conveyor system for receiving a continuous stream of a liquid and for solidifying it into a continuous self-supporting web, means to guide said web vertically downwardly along a predetermined path, means to sever said web into a series of individual sheets which are free from the web in a vertically extending zone, and stacking means which is pivoted upon an axis substantially directly below said zone and which comprises means presenting parallel side surfaces one of which is adapted to engage one of said sheets when said means is moving in one substantially horizontal direction through said zone, and the other of which is adapted to engage a sheet moving in the opposite substantially horizontal direction through said zone and to swing between a position substantially over a stacking zone upon one side of said axis and a stacking zone upon the other side of said axis.

* * * * *